US008359976B2

(12) United States Patent
Caliari

(10) Patent No.: US 8,359,976 B2
(45) Date of Patent: Jan. 29, 2013

(54) METHOD AND MACHINE FOR ALIGNING FLEXOGRAPHIC PRINTING PLATES ON PRINTING CYLINDERS

(75) Inventor: Massimo Caliari, Brescia (IT)

(73) Assignee: Sys Tec S.r.l., Brescia (IT)

( * ) Notice: Subject to any disclaimer, the term of this patent is extended or adjusted under 35 U.S.C. 154(b) by 1191 days.

(21) Appl. No.: 11/915,874

(22) PCT Filed: Sep. 27, 2005

(86) PCT No.: PCT/IT2005/000552

§ 371 (c)(1),
(2), (4) Date: Jun. 5, 2008

(87) PCT Pub. No.: WO2006/129329

PCT Pub. Date: Dec. 7, 2006

(65) Prior Publication Data

US 2009/0013886 A1 Jan. 15, 2009

(30) Foreign Application Priority Data

Jun. 1, 2005 (IT) ..... BS2005A0066

(51) Int. Cl.
*B41F 21/12* (2006.01)
*B41F 3/08* (2006.01)

(52) U.S. Cl. ..... 101/481; 101/248; 101/484; 101/485

(58) Field of Classification Search ..... 101/481, 101/DIG. 36, 248, 484, 485
See application file for complete search history.

(56) References Cited

U.S. PATENT DOCUMENTS

| | | | | |
|---|---|---|---|---|
| 4,484,522 | A | 11/1984 | Simeth | |
| 4,520,389 | A * | 5/1985 | Hornschuh | 348/95 |
| 5,031,334 | A | 7/1991 | Takamura | |
| 5,633,676 | A * | 5/1997 | Harley et al. | 348/95 |
| 5,767,898 | A * | 6/1998 | Urano et al. | 348/43 |
| 5,920,657 | A * | 7/1999 | Bender et al. | 382/284 |
| 6,930,703 | B1 * | 8/2005 | Hubel et al. | 348/37 |
| 7,127,993 | B2 * | 10/2006 | Otten | 101/486 |
| 7,171,901 | B2 * | 2/2007 | Salvestro | 101/401.1 |
| 7,936,936 | B2 * | 5/2011 | Gentric | 382/238 |
| 8,037,819 | B2 * | 10/2011 | Zanoli et al. | 101/485 |
| 2009/0138919 | A1 * | 5/2009 | Mori et al. | 725/75 |

FOREIGN PATENT DOCUMENTS

| | | |
|---|---|---|
| EP | 0999440 | 5/2000 |
| FR | 2657428 | 7/1991 |
| WO | 96/04139 | 2/1996 |
| WO | 2005/105449 | 11/2005 |

* cited by examiner

*Primary Examiner* — Daniel J Colilla
*Assistant Examiner* — Allister Primo
(74) *Attorney, Agent, or Firm* — Shoemaker and Mattare

(57) ABSTRACT

The invention relates to a method and a machine for aligning at least two flexographic printing plates on at least one printing cylinder. The method comprises the steps of capturing an image relating to a first plate, capturing the image relating to a portion of a second plate, reprocessing the image captured from the first plate so as to obtain a portion thereof corresponding to the image relating to the portion of the second plate, concurrently displaying said reprocessed image and the image captured from the second plate and aligning said two images.

5 Claims, 7 Drawing Sheets

Fig. 3
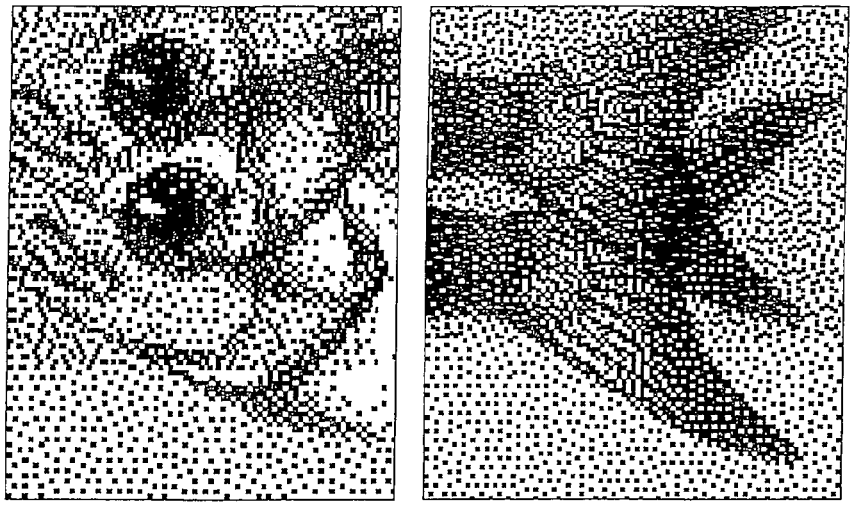
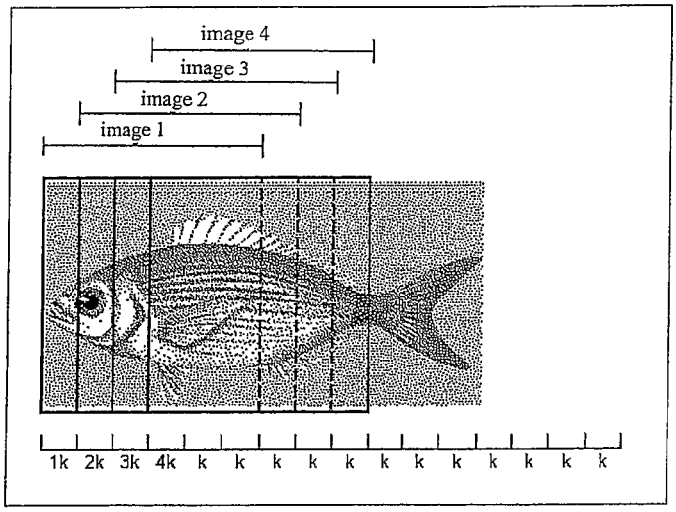
Fig. 6
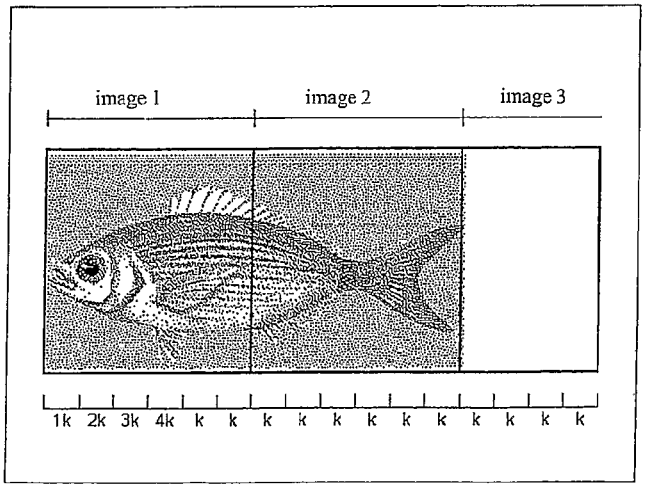
Fig. 7

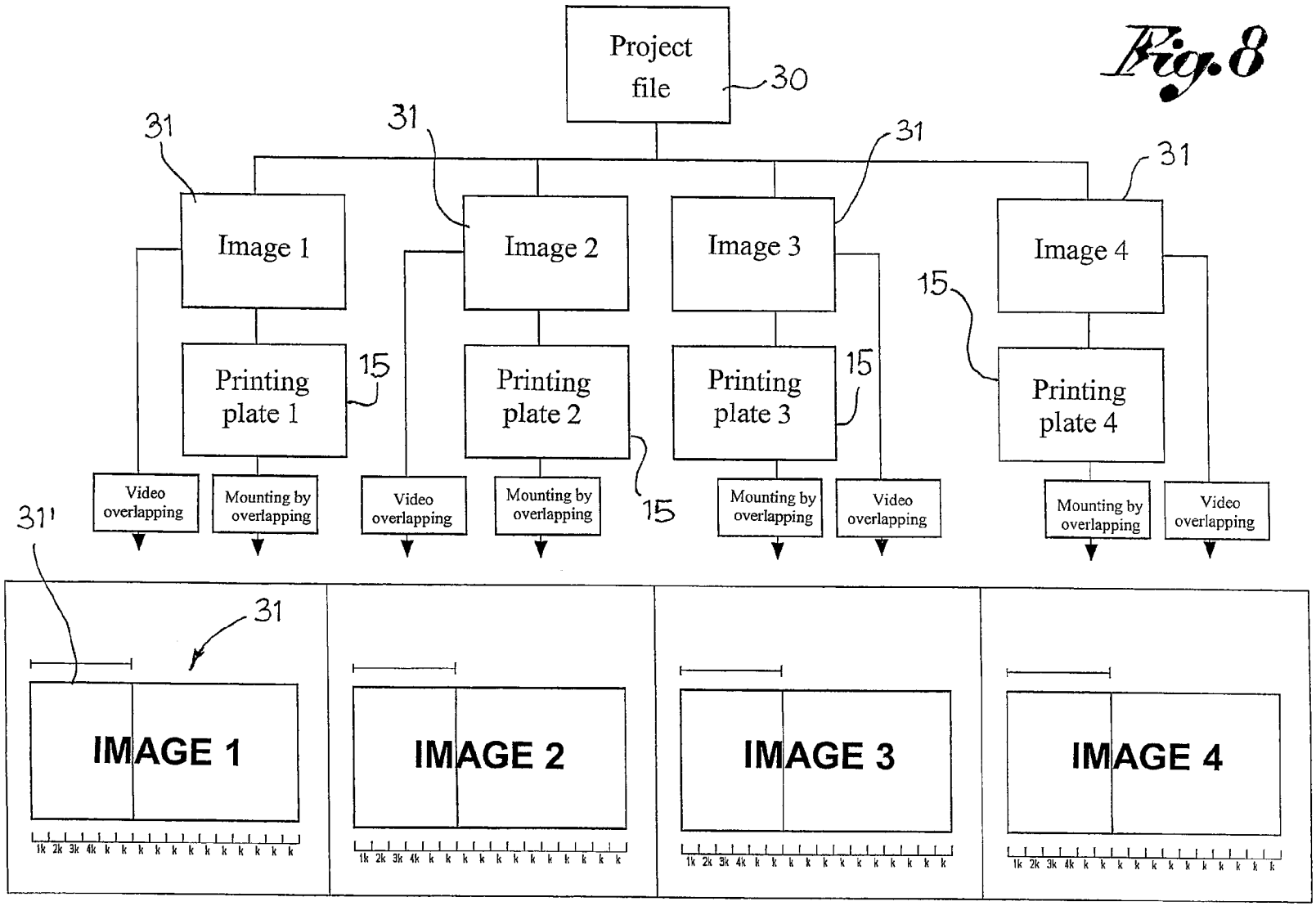
Project file
30
Image 1
Image 2
Image 3
Image 4
31
Printing plate 1
Printing plate 2
Printing plate 3
Printing plate 4
15
Mounting by overlapping
Video overlapping
IMAGE 1
IMAGE 2
IMAGE 3
IMAGE 4
1k 2k 3k 4k k k

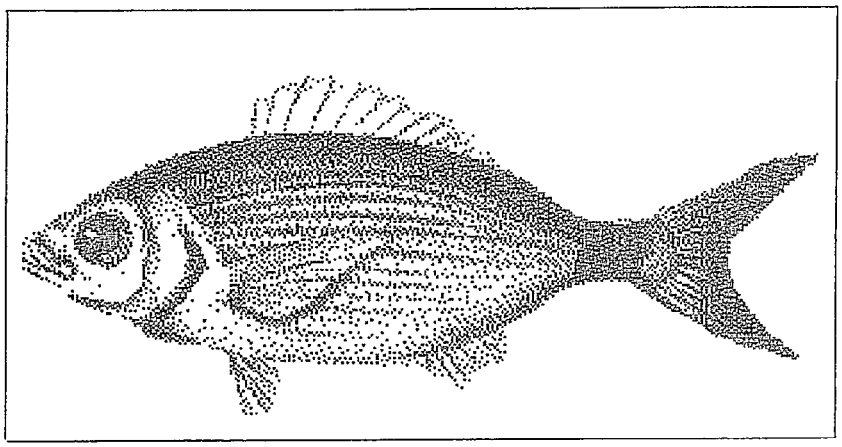
Fig. 9
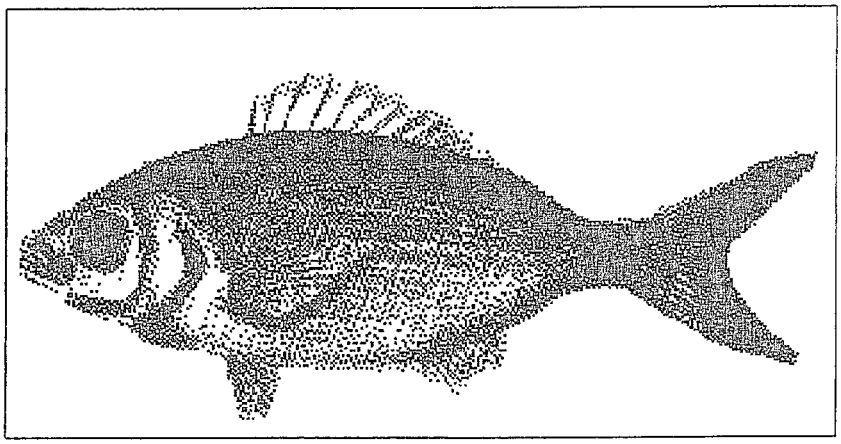
Fig. 10
Fig. 11
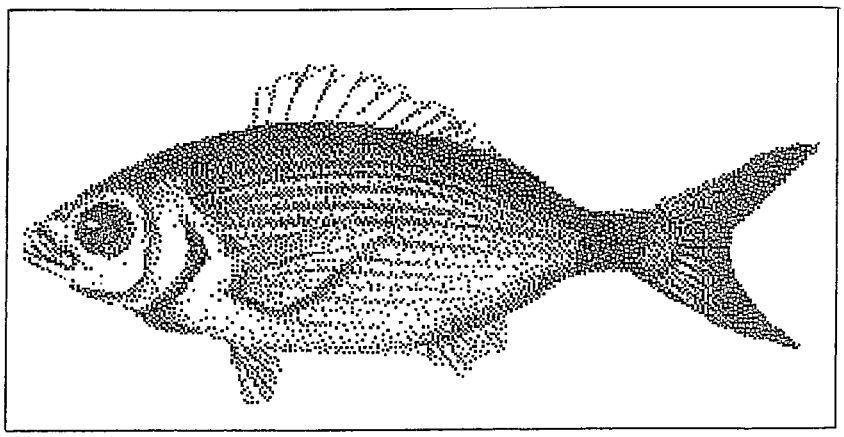

METHOD AND MACHINE FOR ALIGNING FLEXOGRAPHIC PRINTING PLATES ON PRINTING CYLINDERS

FIELD OF THE INVENTION

The object of the present invention is a method and a machine for aligning flexographic printing plates on printing cylinders.

DESCRIPTION OF THE RELATED ART

As known, flexible plates or clichés are used in the field of package printing, for example flexible packages, PVC wrappers, paper bags, tablecloths, serviettes, cases for the paper industry, whereon there are rises suitable for obtaining the pattern, or the pattern portion to be printed.

In particular, if multicolour images are to be printed, it is necessary to provide for a plurality of plates, each having only the pattern portion to be produced in the respective colour in relief. This plurality of plates if individually fixed onto separate printing cylinders or sleeves, so as to separately transfer the respective colour, deposited onto the rises, to the tape, for example of paper, that slides or rolls on these revolving cylinders.

For the different plates to produce a single multicolour images it is essential that they are perfectly aligned with each other or, in other words, that they work on the same portion of the tape or paper film to be printed. To this end, they must be mounted onto the respective printing cylinder in the same position.

One of the needs for obtaining sharp images and prevent overlapping the different colours of a same image therefore is to make the positions of the different plates used to produce these images perfectly coinciding on the respective printing cylinders. In other words, the plate position on the cylinders must always be the same.

A prior patent application no. PCT IT2004/000244 by the same Applicant discloses a method for aligning flexographic printing plates on printing cylinders which envisages positioning a first plate on a respective printing cylinder, framing a portion of said plate by an image capturing device, such as a camera, saving the image of the framed plate, viewing the saved image in transparency of a viewing device, such as a monitor, framing a portion of a second plate to be aligned with the first one and viewing the framed image overlapping it to the image in transparency.

In this way it is possible to align the subsequent plate with the image of the previous plate by overlapping and contrast.

This mounting method solves a series of problems that were already noted in the mechanical mounting systems, such as the need of carrying out a printing test (the so-called "draft"), the construction of machines provided with expensive mechanical precision systems, etc.

Moreover, the mounting carried out in this way allows the operator to do without any reference mark on the flexographic plate, since the plates can be aligned on the intrinsic references detectable from the displayed image. On the other hand, in the conventional mounting, any removal of the printing references or crosses or marks implies the impossibility to carry out the plate mounting.

PCT IT2004/000244 also discloses the storage of the camera parameters relating to the image and to the relevant position.

In fact, it is clear that in a plate mounting based on a reference image, if the parameter of the live image (that is, framed in real time) are changed as compared to the parameters of the "virtual" image (that is, previously captured and stored), this cannot be suitable anymore as a reference for overlapping the next images.

For example, if the zoom factor of the live image is varied as compared to that used by the operator when the virtual image was saved, the live image would not correctly overlap to the reference image anymore.

In the practice, the next plates could not be aligned with the reference one anymore.

Thus, PCT IT2004/000244 also discloses the saving of the camera parameters in relation to an image and a position.

The method for mounting flexographic plates described above is clearly innovative, but in the practice it exhibits a limitation: the saving (or, in other words, "sampling") of an area of the plate is limited to the (more or less broad) portion of image captured by the camera.

This means that if the operator wants to inspect a point of the plate which is not saved or "sampled", he/she has no reference image to compare to a subsequent plate in that point.

For example, let's assume that we have a first printing plate as that shown in FIG. 1.

Let's further assume that an operator has saved two images of such reference plate to align the plates subsequent to the first one; the images may be, for example, those shown in FIGS. 2 and 2*a*.

At this point, the operator could align the subsequent plates on these two images, overlapping the plate framed in real time by a camera to the virtual image saved before (FIG. 3).

But if for a plate subsequent to the first one you want to compare a different area from those saved, there is no reference image, unless a first cylinder is positioned again on the cliché holder machine and a further image is sampled.

In the practice, the inspection of an area of the plate different from that carried out for mounting may be very useful, for example to check that a detail of the pattern where special accuracy is required (for example, an intensified colour) is correctly positioned, to check the correct alignment of the four colour points, or that at a mechanical level the presence of any air bubbles or flaws in laying the bi-adhesive tape under the plate does not affect the mounting result.

The object of the present invention is to obviate such a limitation of the alignment method described above.

SUMMARY OF THE INVENTION

The object is achieved with a method for aligning flexographic printing plates on printing cylinders in accordance with claim 1 and with a machine in accordance with claim 16.

BRIEF DESCRIPTION OF THE DRAWINGS

The features and advantages of the method and machine according to the present invention will appear more clearly from the following description of preferred embodiments, made by way of an indicative non-limiting example with reference to the annexed drawings, wherein:

FIG. 3 shows a step of the alignment procedure for a second plate with the first one by overlapping to the images of FIG. 2, according to the method described in patent application no. PCT IT2004/000244;

FIG. 6 schematically shows an operation for capturing an image of the surface of the entire plate through scanning;

FIG. 7 schematically shows the operation for capturing the same image of FIG. 6, in a preferred embodiment of the method according to the present invention;

FIG. 8 shows a block diagram of an embodiment of the alignment method according to the invention;

FIG. 9 shows an image of the plate of FIG. 1, after it has been processed to highlight only the relief portion thereof;

FIG. 10 shows an example of a wrong overlapping of two images processed as in FIG. 9; and FIG. 11 shows an example of correct overlapping of two processed images.

DETAILED DESCRIPTION OF THE INVENTION

Figure 1:
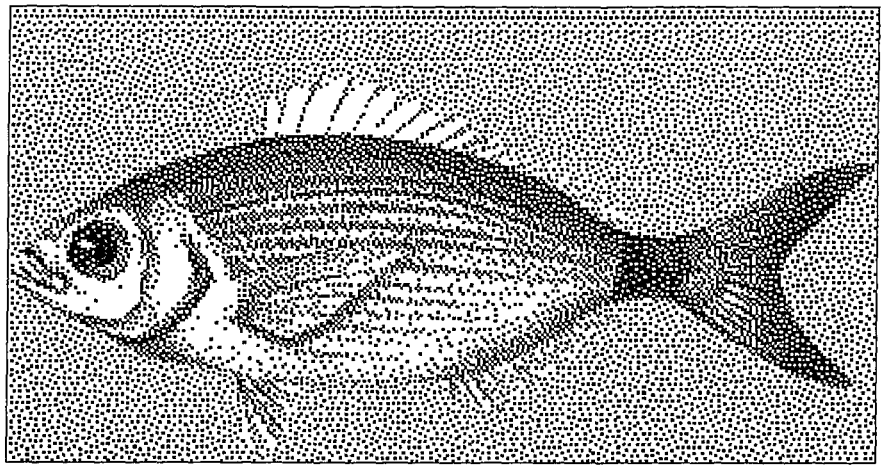
FIG. 1 shows an example of a flexographic plate.
Figure 2:
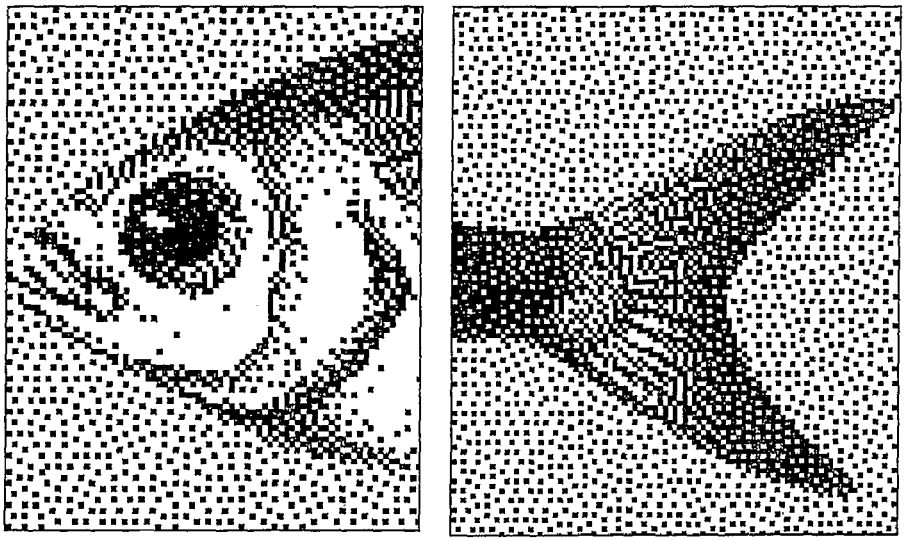
FIG. 2 shows two images relating to two portions of the plate of FIG. 1.
Figure 4:
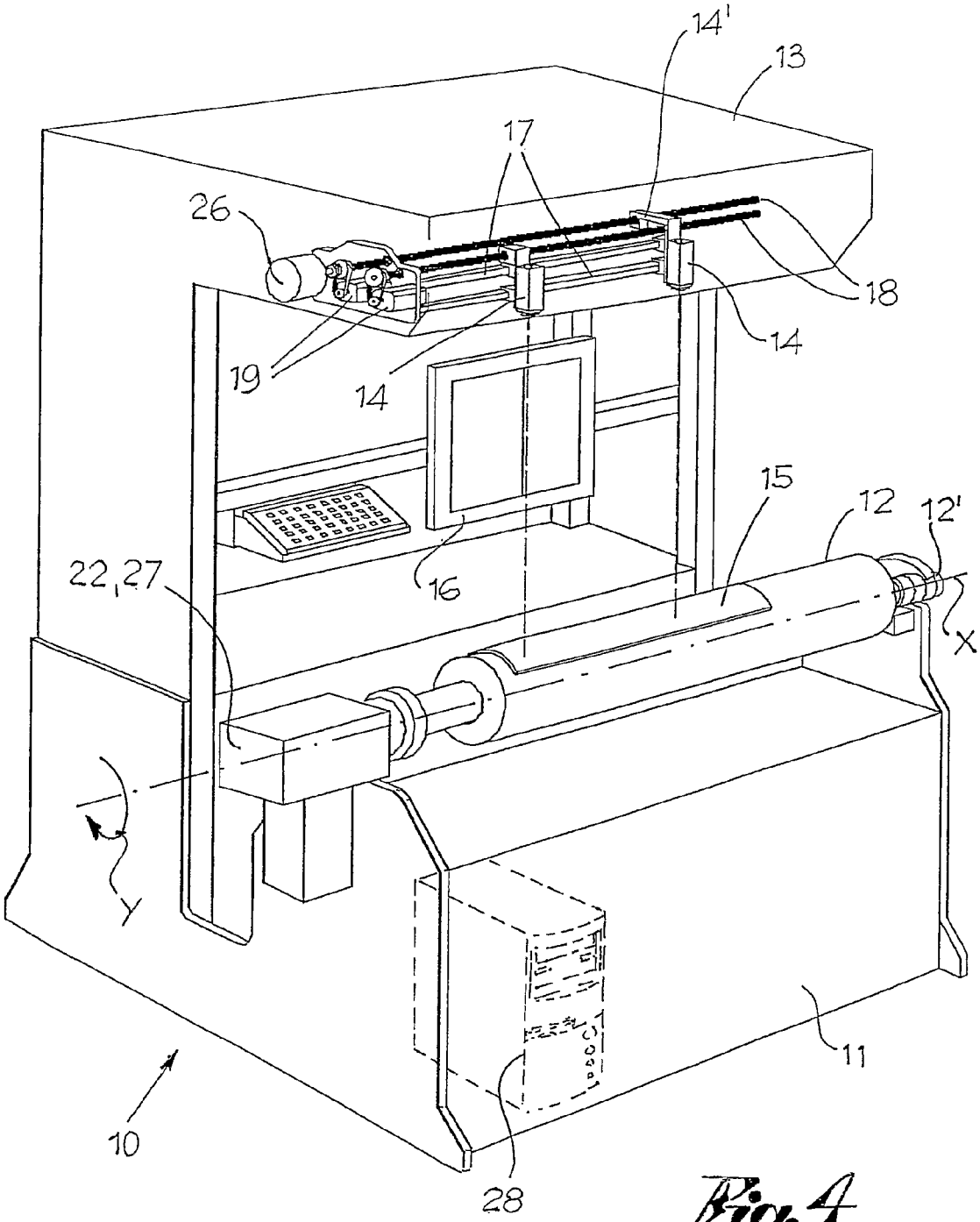
FIG. 4 shows a schematic perspective view of an example of a machine for aligning printing plates on printing cylinders.

With reference to FIG. 4, the machine for mounting flexographic plates on printing cylinders exhibits a structure 10 substantially comprising a bench 11 suitable for turnably supporting a printing cylinder 12. A frame 13 extends behind and on top of said cylinder, suitable for supporting at least one image capturing device 14 movable to a direction substantially parallel to the axis of the printing cylinder to shoot or frame a portion of a printing plate 15 mounted on cylinder 12. The image capturing device is associated to a viewing device 16 intended for displaying the images captured by said capturing device.

Image capturing device is a transducer or sensor suitable for shooting or framing an item located within its field of vision and for converting the shot or framed image into a flow of electrical data suitable for being transmitted to a viewing device, which is capable of transforming said data into signals suitable for visually reproducing, virtually in real time, the framed image.

Thus, in the following description,

"framed image" will mean: the image relating to the portion of a plate that at a certain time is within a field of vision of an image capturing device;

"captured image" will mean: a framed image converted into a flow of electrical data suitable for being displayed by an image viewing device;

"stored image" will mean: a captured image saved to a storage device so as to be used, for example displayed, after the capture;

"reprocessed or reorganised image" will mean: an image obtained through the processing or reorganisation of the electrical data defining a captured or stored image.

Moreover, a captured image can be obtained both from a single framing of an image of a portion of a plate and, as is better described hereinafter, from the composition of multiple images of a plate, framed for example in a sequence.

In a preferred embodiment, the image capturing means consist of two cameras. Cameras 14 are fixed to respective carriages 14' sliding on respective guides 17. Each carriage 14' is movable through a respective worm screw 18 controlled by a respective motor 19 mounted on frame 13.

The printing cylinder 12 is provided with a shaft 12' controlled in rotation by a motor 22.

Advantageously, motors 19 for actuating cameras 14 and motor 22 of the printing cylinder are associated to respective position sensors 26, 27. The position sensors 26 associated to the cameras may be of the angular type, for example encoder, or of the linear type, for example optical guides, magnetic guides, etc.

Cameras 14, the viewing means 16, motors 19, 22 and the position sensors 26, 27 are controlled by a processing unit 28, for example a personal computer. Said processing unit 28 is provided with a monitor that is advantageously suitable for forming the viewing means 16.

Each camera 14 is provided with means intended for setting and adjusting optical, mechanical and electronic parameters, which characterise the image capturing and processing. These devices comprise an electronic interface managed by the processing unit 28.

Optical or mechanical parameters of the camera typically are the zoom and focus factors.

In particular, the electronic parameters are the digital zoom, the colour gain index, the colour contrast value, the colour saturation value, the colour hue value and the image brightness value.

Cameras 14 are associated to storage means suitable for storing the electrical data relating to the captured images, that is, all the digital and analogue data that define the information making up the visual representation of an image framed or shot by the camera. In the preferred embodiment described herein, the storage means comprise permanent storage managed by the processing unit 28.

Monitor 16 can thus display both an image framed in real time by a camera and an image already captured and stored.

In particular, monitor 16 can concurrently display an image already captured and stored serving as a background and an image relating to a plate portion shot in real time. In other words, the storage means allow overlapping at least two images to one another. Since an image shot by the camera consists of infinite dots, aligning the second image or those subsequent to the first one consequently gives the alignment of the second plate and of those subsequent to the first one.

In the practice, each plate exhibits relief portions that are intended for producing corresponding portions of the graphical pattern to be printed having a same and single colour. Therefore, generally two or more overlapped images are aligned when the corresponding relief portions displayed at the same time are perfectly next to one another in composition, that is, so as to be complementary, thus jointly defining the graphical pattern to be printed.

In the particular case where two plates are identical, the overlapping and alignment of the relevant images would imply the exact overlapping of the relief portions as well.

Advantageously, moreover, the storage means may be associated to multiple cameras and relevant viewing means, so that an image captured by a camera may be stored and displayed on the viewing device associated to a different camera.

The idea at the basis of the present invention is the possibility of sampling or of capturing and storing a larger printing area than what can be framed by a camera, and in particular, the entire surface of the printing plate 15. In other words, an image of the entire plate is captured, rather than just of the area framed by the camera.

In this way it is possible to always display, for each point of a second plate to be aligned to the first one, the corresponding reference image relating to the first plate, since by moving a camera 14 to any point in its travel, the captured image can be compared to the corresponding portion obtained by the processing unit 28 by reorganising the image relating to the first plate based on the resolution of the camera used and on the position wherein the camera frames a portion of the second plate.

Figure 5A:
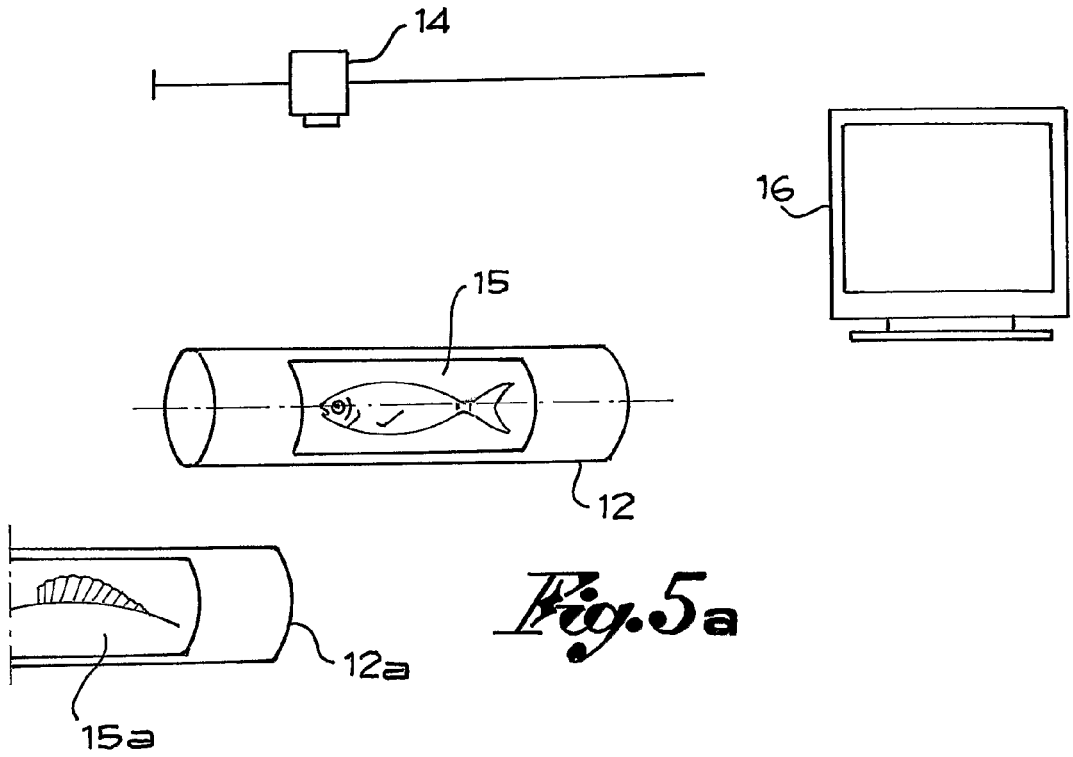
FIGS. 5*a*-5*d* schematically show an example of embodiment of the alignment method according to the present invention.
Figure 5B:
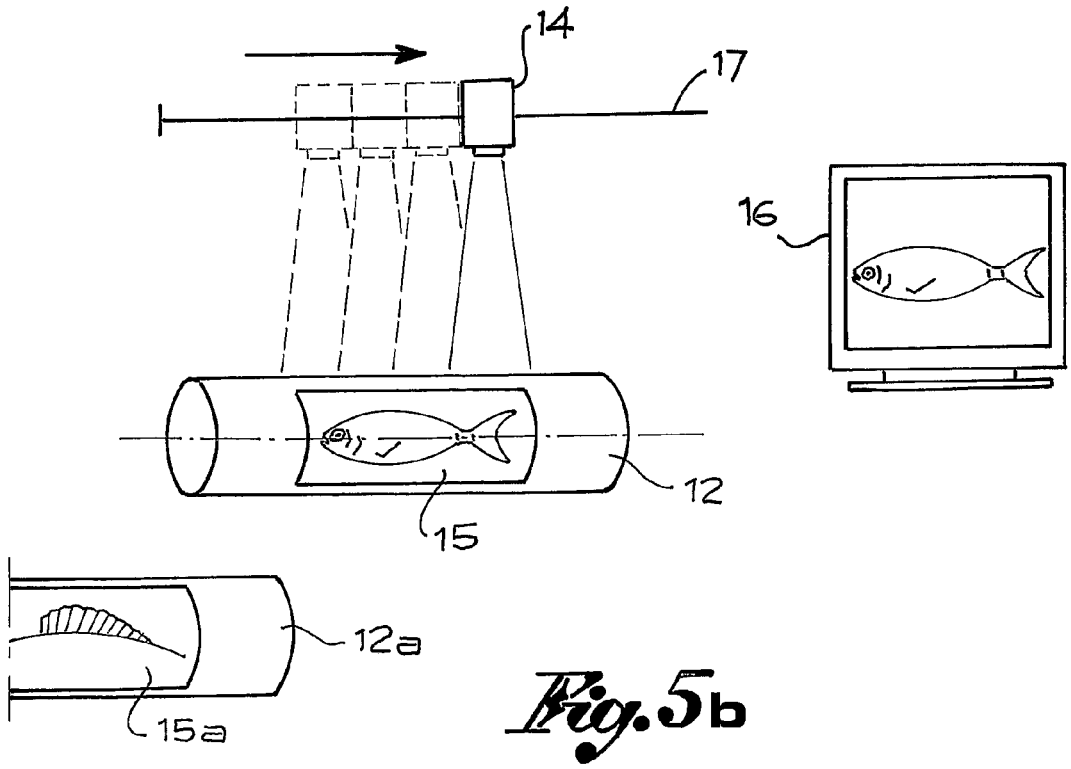
Figure 5C:
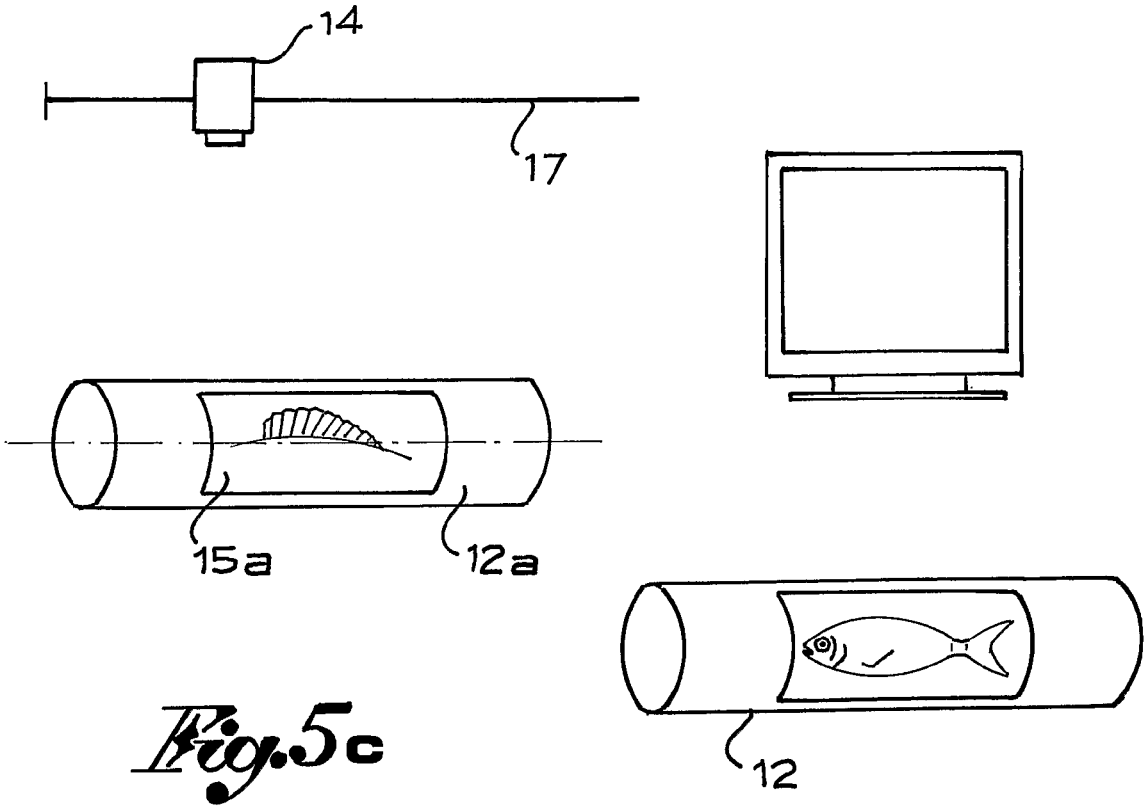
Figure 5D:
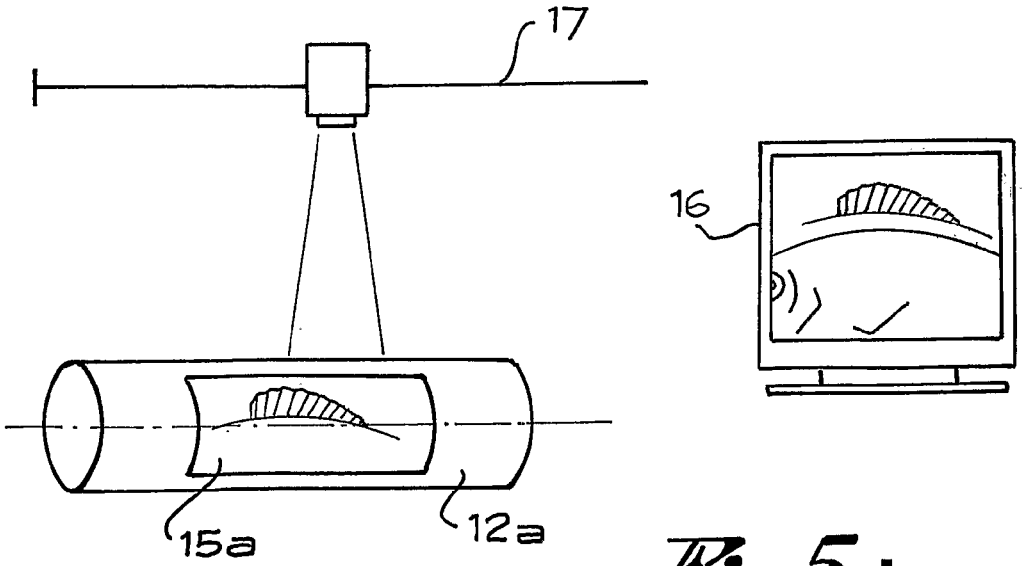

An example of method for aligning two flexographic printing plates 15, 15*a* onto respective printing cylinders 12, 12*a* is generally described hereinafter. The method uses the machine for mounting flexographic plates onto printing cylinders described hereinabove and illustrated in FIG. 4, and comprises the steps of:

- mounting a first printing plate 15 onto the respective printing cylinder 12 (FIG. 5*a*);
- moving a camera 14 along the full travel thereof, that is, along the guiding means 17, so as to capture the entire image of the first plate (FIG. 5*b*);
- storing the image captured;
- removing the first cylinder 12 and mounting the second cylinder with the second plate 15*a* to be aligned to the first one (FIG. 5*c*);
- moving camera 14 to any desired position;
- capturing the image of the portion of the second plate framed by the camera;
- storing the position of the camera relative to a spatial reference, for example provided at the beginning of the guiding means 17 of the camera;
- reprocessing the image relating to the first plate so as to obtain a portion thereof corresponding to the image captured from the second plate;
- concurrently viewing said reprocessed image and the image captured from the second plate (FIG. 5*d*); and
- moving the second plate on the cylinder until the image captured from the second plate is aligned with said reprocessed image (FIG. 5*d*).

It should be noted that is also possible to align multiple plates concurrently mounted on a same cylinder or on different cylinders, for example using multiple cameras. In this case, it is not necessary to store the image relating to the reference plate, said image being reprocessable while it is captured by the relevant camera.

For higher clarity of description, in the following description reference is made, without limitation, to the case of plates to be aligned in a sequence onto respective printing cylinders, and therefore to the need of storing the image of the reference plate.

At a practical level, the method described above may be implemented using three types of cameras 14: linear scanning cameras, progressive scanning cameras and standard or interlaced cameras.

A linear scanning camera is an image capturing device whose sensor consists of a single line of photosensitive elements (pixels). Thus, unlike the area (or matrix) sensors that capture frames, the capture occurs line by line.

A single scanning line may be considered as a monodimensional mapping of the brightness of the single points of the observation line.

A linear scan generates a line that shows the brightness of each pixel in grey (0 to 255 levels) or colour levels (24 bit depth). A sudden variation of the grey and/or colour level of a single pixel corresponds to a point of the outline of an item or to the presence of a colour or appearance variation. The detection of such variation therefore allows having a precision measure also enabled by the high resolution of the linear sensor, much higher than that of an area sensor.

To carry out the scanning of the entire plate, or of a portion thereof larger than that framed by camera 14, the user sets a constant pitch (K) relating to the movement of the camera (such as, from 0.001 mm on), based on the desired image capturing accuracy.

The user therefore moves camera 14 by motors 19 or by hand, on machines not provided with any motors.

The processing unit 28, through the position sensors 26, captures the position of camera 14 relative to a spatial reference provided, for example, at an end of guides 17 and, once each predetermined value K is reached, it starts the image capture.

The scanning line captured is queued to the previous one, so that at the end of the scan, the sum of the single captures generates the overall image as a whole.

In progressive scanning cameras (not interlaced), the data relating to the image is simultaneously accumulated and then unloaded, line by line or sequentially, not interlaced.

The result is an image that, if captured with a quick shutter, exhibits a full resolution, both vertically and horizontally.

Progressive scanning cameras solve the typical problem of quality of the captured images of conventional (interlaced) cameras.

In fact, a conventional interlaced camera captures each half-frame (1 frame=2 half-frames) with a halved vertical resolution; this is because the capture occurs through two sequential half-frames (odd lines are scanned in the first half-frame, even lines in the second one).

In the case of a dynamic capture of the image, when the second half-frame is stored and scanned, the subject has already moved. The result is a blurred image once the two half-frames are combined with each other to obtain an interlaced image.

This is solved by adopting the progressive scan. The progressive scan is generally associated with the electronic shutter. In the practice, the capture speed is selected by varying the charge accumulation time on a single pixel.

Also in this case, the user sets the constant pitch (K) relating to the movement of the camera (for example, from 0.1 mm on).

The user then moves the camera so as to capture the entire image.

The processing unit 28, through the position sensors 26, captures the position of the camera and, once each predetermined value K is reached, it starts the image capture and stores the same adding the position value to the parameters.

After that, by moving the camera to any point of its travel, the captured image can be compared to the corresponding image captured before in that same predetermined position.

The use and the operation of conventional or interlaced cameras is similar to that of progressive scanning cameras, with the difference that, during the movement of the camera along the guiding means 17, once each value of the movement of the camera (K) is reached, the system must be stopped for the time needed to prevent storing a blurred image.

In the case of capture with manual movement of the camera, the process must therefore be slow so that the images captured are not blurred when the system starts the image capture.

In all cases, when the processing unit 28 detects the position variation equal to the predetermined movement value (K), an image is captured and saved to a database along with a series of parameters relating to the same (e.g., zoom value, chromatic factors, etc.), as well as to the absolute position value. Said absolute position is defined by the camera position along axis X parallel to the axis of cylinder 12 and by the angular position Y of the cylinder about the axis thereof.

It should be noted that the saved images that form the image of the first plate are partly overlapped (the shifting between one and the other being equal to K), and therefore, a number of images is saved that is an inversely proportional function of value K (FIG. 6).

Advantageously, it is possible to carry out scans with multiple zoom values, so that once the zoom value with which the second plate is framed is known, the stored image with the same zoom value is automatically displayed.

It should be noted that the movement value K is a function of both the movement value along axis X (longitudinal movement of the camera) and of the angular movement value Y (cylinder rotation angle). Thus, the procedure described above may be applied to axis X and/or to movement Y.

In accordance with a preferred embodiment of the method according to the invention, the processing unit is programmed to carry out a function of collimation of the images of two adjacent areas.

In fact, knowing the distance between one pixel and another, the processing unit is capable of knowing which the spatial dimensions of the framed image are in relation to the zoom factor used. The camera will therefore automatically sample the images based on the space between each other, that is, based on the dimension of the same (FIG. 7).

This function allows preventing the sampling of several images that on the other hand occurs in the method described above.

For example, framing an area of 75 mm in the horizontal direction and 50 mm in the vertical direction with a fixed focus camera and a definition of 1024 horizontal pixels and 768 vertical pixels, it is evident that the image resolution is always the same since 75 mm/1024 pixels (in the horizontal direction) correspond to a definition Kh of 0.073 mm per each pixel, whereas in the vertical direction, the resolution is Kv=50 mm/768 pixels=0.065.

The problem occurs with cameras provided with optical zoom, for example 10×, where the framed image adapted with special optical systems of 150 mm×100 mm in Wide becomes of 15 mm×10 mm in Tele.

By way of an example, let's consider the following table that shows the dimensions of the framed area based on zoom factors of a camera having an optical zoom with magnification factor of 10×.

| Zoom factor | 1 | 2 | 3 | 4 | 5 | 6 | 7 | 8 | 9 | 10 |
|---|---|---|---|---|---|---|---|---|---|---|
| Framed image (in mm) | 150 × 100 | 135 × 90 | 120 × 80 | 105 × 70 | 90 × 60 | 75 × 50 | 60 × 40 | 45 × 30 | 30 × 20 | 15 × 10 |

In accordance with a variation of embodiment of the method according to the present invention, an image contained in a single graphical file relating to a single printing plate is used as a reference image, rather than an image resulting from the scan of a plate.

In fact, it is known that in the field of flexographic printing, the production cycle of the printing plates begins from the production of a graphical file 30 that represents the final printing result.

This graphical file, also called "project" file, is then split up into the single files 31, each of which is associated to a respective printing plate 15. The graphical files may be of several formats: PDF, EPS, TIFF; etc.

In the flexographic printing, each colour corresponds to a single plate, and the perfect overlapping in the print of all plates 15 results in an image equal to the "project" image 30.

In the practice, by selecting the file 31 corresponding to a plate, the user obtains just this file in video overlapping. Knowing the dimensions of the job, the dimension corresponding to a single pixel in relation to the zoom factor used at the time by the user for framing plate 15, the processing unit 28 is programmed for displaying on the monitor a portion 31' of the reference image 31, having dimensions corresponding to those of the area framed in real time by the camera (FIG. 7).

The operator can therefore overlap the image relating to plate 15 to the reference image, without performing any prior capture or scan.

A practical example of capture and processing of the images based on the zoom factor shall now be described.

If cameras provided with optical system without variable zoom factor are used (so-called fixed optical system) with zoom factor ratio of 1:1, the problem of the adaptation of the stored image to be used for the comparison in the overlapping with the image captured in real time by the camera does not apply.

This because both the physical dimensions of the framed image and the number of pixels (given by the features of the camera sensor, for example 1024×768) are equal to those previously stored.

It is therefore possible to sample the entire plate area, or portions thereof, and knowing the zoom factor used, automatically, the processing unit is capable of tracing back the dimensions of the framed area and can process the image and display it again in a correct dimension to be overlapped to the image framed in real time.

In the first example above, the framed area (75×50 mm) would correspond to a zoom factor 6× using the 10× lens of the table.

If a camera with a resolution of 1024×768 pixels is used as a reference, it is possible to gather the minimum detail and the image capturing accuracy based on the zoom factor, precisely:

in "wide", the image captured with a horizontal definition equal to 150 mm/1024 pixels corresponds to 0.146 mm per each pixel;

in "tele", at the maximum value (10×), the image captured with a horizontal definition equal to 15 mm/1024 pixels corresponds to 0.015 mm per each pixel.

Therefore, normally, the sample image must be captured with a predetermined zoom value and the same must be kept constant to compare the subsequent images.

As an alternative, it is necessary to capture and store the sample image with all the zoom factors to be recalled afterwards for the comparison with the same image stored with the same zoom factor as the image framed in real time.

These limitations are overcome with the use of digital image processing programs, thanks to which it is possible to sample and store the images with any zoom factor and reprocess them based on the zoom value/area matrix used on the camera that frames the second plate in real time.

There are various image processing methods, such as the image interpolation method and the vectorial image processing method.

The first method is normally used to interpolate the missing pixels needed to generate a virtual image larger than the real image captured.

The missing pixels are weighed, averaging the colour between two adjacent pixels of the real image and they are inserted between the two with a tone-on-tone colour hue.

Let's assume, for example, that we have captured a reference image with a camera of 1024 pixels (horizontal) by 768 pixels (verticals) and with a zoom factor of 6× which corresponds to a framed image sized 75 mm (in the horizontal direction) by 50 mm (in the vertical direction).

Let's now assume that we need to compare such stored image to an image captured from a second plate with a zoom factor 7×, corresponding to an image sized 60 mm×40 mm.

To properly make the comparison (that is, the overlapping of the two images) it is necessary to expand and interpolate the stored image with a calculation allowing the number of pixels to add to be known.

More precisely, for the horizontal axis it is necessary to:

calculate the image/pixels ratio between the 75 mm in the horizontal direction of the framed image corresponding to the zoom factor 6× and the value of the camera sensor of 1024 pixels in the horizontal direction: 75/1024=0.073.

Calculating the number of missing pixels to be added: [75 mm (stored image)-60 mm (framed image)]/0.0732 (image/pixels ratio)=204 pixels to add.

Calculating the number of pixels making up the stored image corresponding by dimension to the framed image: 60 mm/0.0732 (image/pixels ratio)=820 pixels. Such image of 820 pixels must be expanded to the 1024 pixels of the framed image.

Calculating the number of pixels after which a missing one must be added: 820 (partial pixels of the image to be enlarged)/204 (pixels to be added)=4.029 pixels. In the practice, at every four pixels one must be added, calculating the colour weight between the two pixels where it must be placed.

The same calculation must be made for the vertical axis.

The same procedure applies if the stored image is larger than that displayed in real time. In this case, the reference image exhibits more pixels than that being captured, and therefore the pixels are to be removed to obtain the same image size/number of pixels ratio.

As regards the second image processing method, with special software it is possible to obtain a vectorization of the points detected on a stored image into basic geometrical elements (such as straight lines, arcs, circumferences, ellipses, etc.) and a subsequent reprocessing based on the zoom factor of the lens and thus, of the image to be obtained, with subsequent rasterization and regeneration of the virtual image to be overlapped to the real one being captured.

It should be noted that the reference images captured by scanning the plates may be further worked and processed with special image processing programs to facilitate the subsequent overlapping with the image framed in real time and to simulate a printing test.

For example, it is possible to associate each image to a certain colour hue to facilitate overlapping and accent the contrasts so as to highlight any alignment mistakes.

Moreover, it is possible to obtain an image that only corresponds to the plate relief, that is, without background. By associating each image thus reprocessed to a different colour hue corresponding to the inks that will be used in the printing step and overlapping the images it is possible to generate a graphical simulation file corresponding to the real image that will be printed. The file thus obtained can also be printed with standard and low-cost ink-jet printers for a general assessment of the overlapping quality.

Two examples of procedures that allow tracing back only the relief portion of a printing plate with a camera shall now be described.

According to a first method, one or more light sources are arranged and adjusted to impinge the plate so that light is reflected only by its portion in relief. A difference of colour between the relief portion of the plate, which reflects the light and accents the outline as well, and the lower portion of the same, that is, the background, that remains shaded and hidden, is thus produced.

In accordance with a second method, the plate is inked by a manual roll with a predetermined colour, as if it were a stamp. This operation is actually carried out for carrying out a real printing test with paper.

Once the image of the printing plate thus illuminated or inked has been captured, the processing unit 28 is programmed for:

analysing the pixels captured and, with a tolerance filter that can be preset by the operator, recognising those that determine the relief;

optionally matching said pixels with a colour for simulating the ink of the printing machine; and excluding the remaining pixels matching them with a neutral or clear colour.

The resulting image of the plate is, for example, that shown in FIG. 11, where the absence of the background may be noted.

Of course, the two methods described above may be combined with one another (for example, inking with white colour and lighting with Wood light).

In summary, through the application of these filters it will be possible to obtain a file with only the spatial relief portion of the plate. The non-relief elements of the plate will therefore be eliminated from the graphical files.

This will allow the use of very sharp images for video or printing overlapping: any non-aligned colour will be clearly visible (on the video or the printout) and highlighted relative to the image given by the overlapping of the various colours.

For example, FIG. 10 shows a wrong overlapping of two images with a clear outline: the overlapping error is clearly visible.

FIG. 11, on the other hand, shows a correct overlapping between the two plates. In this case, a sharp image is displayed on the video, with the colours correctly overlapped so as to form correct printing points (four colours).

It should be noted that the virtual simulation of the printing test on paper obtainable with the procedure described above allows preventing the real printing test step, a very complex operation that requires several work hours of the operator. Moreover, the construction of the machine for mounting the plates is highly simplified, since the machinery used for the printing test operation, such as the printing test drum, the mechanical connecting members of the printing cylinder to the drum, the electrical cylinder and drum actuating members with the relevant electronic control equipment are not needed anymore.

The invention claimed is:

1. A method for aligning at least two flexographic printing plates on at least one printing cylinder, comprising the steps of:

capturing an image relating to a first plate;

capturing an image relating to a portion of a second plate;

reprocessing the image captured from the first plate so as to obtain a portion thereof corresponding to the image captured from the second plate;

concurrently viewing said reprocessed image and the image captured from the second plate; and moving at least the second plate by bringing the image captured from said second plate next to said reprocessed image in composition, wherein, given a value of the zoom factor of an image capturing device having a definition expressed in pixels/mm, the image captured from the first printing plate is obtained by calculating the spatial dimensions of the image that can be framed by said capturing device, capturing a plurality of images at spatial intervals equal to the distance between said images and collimating the images captured with one another.

2. A method according to claim 1, wherein, given a first value of the magnification or zoom value used by an image capturing device for capturing the image relating to the first plate, and a second zoom value, differing from the first one, used by an image capturing device for capturing the image relating to a portion of the second plate to be aligned to the first one, the step that provides for obtaining from the image captured from the first plate, a portion thereof corresponding to the image captured from the second plate comprises an operation for calculating the spatial dimensions of the image captured with the first zoom value and a subsequent processing of said image to adapt the spatial dimensions thereof to the spatial dimensions of the image captured with the second zoom value.

3. A method according to claim 2 wherein, given a resolution of the image capturing device defined by a number of pixels along an axis X by a number of pixels along an axis Y orthogonal to axis X, and knowing the spatial dimensions of the captured image for each zoom value used, said image processing comprises the steps of:

calculating, for each of the two axes X, Y, the relation between the dimension of the image captured with the first zoom value and the number of pixels;

calculating, for each of the two axes X, Y, the difference between the number of pixels of the image captured with the first zoom value and the number of pixels of the image captured with the second zoom value;

reprocessing the image captured with the first zoom value so that it exhibits the same spatial dimension as the image captured with the second zoom value;

calculating, for each of the two axes X and Y, the number of pixels making up said reprocessed image; and calculating, for each of the two axes X, Y, the number of pixels of the reprocessed image after which a missing pixel must be added or removing an excess pixel as compared to the number of pixels of the image captured with the second zoom value.

4. A method for aligning at least two flexographic printing plates on at least one printing cylinder, comprising the steps of:

capturing an image relating to a first plate;

capturing an image relating to a portion of a second plate;

reprocessing the image captured from the first plate so as to obtain a portion thereof corresponding to the image captured from the second plate;

concurrently viewing said reprocessed image and the image captured from the second plate; and moving at least the second plate by bringing the image captured from said second plate next to said reprocessed image in composition, wherein the capture of the image relating to the first plate is obtained from a graphical file corresponding to the first plate and the step of obtaining from the image relating to the first plate a portion thereof corresponding to the image relating to the portion of the second plate comprises art steps of calculating the spatial dimensions of the image of the graphical file, comparing said dimensions with the travel of the image capturing device, and subsequently processing of the image of the graphical file based on the current position of said capturing device and on for a zoom factor used while capturing the image of the portion of the second plate.

5. A method for aligning at least two flexographic printing plates on at least one printing cylinder, comprising the steps of:

capturing an image relating to a first plate;

capturing an image relating to a portion of a second plate;

reprocessing the image captured from the first plate so as to obtain a portion thereof corresponding to the image captured from the second plate;

concurrently viewing said reprocessed image and the image captured from the second plate; and moving at least the second plate by bringing the image captured from said second plate next to said reprocessed image in composition, treating each plate the image of which has to be captured so as to highlight the relief portion therefore relative to the background;

capturing the image;

analysing the electrical data that define the image captured so as to distinguish the data relating to the relief portion from those relating to the background; and excluding the data relating to the background.

* * * * *